US010392916B2

(12) United States Patent
Moos et al.

(10) Patent No.: US 10,392,916 B2
(45) Date of Patent: Aug. 27, 2019

(54) SYSTEM AND METHOD FOR USING PRESSURE PULSES FOR FRACTURE STIMULATION PERFORMANCE ENHANCEMENT AND EVALUATION

(71) Applicant: BAKER HUGHES INCORPORATED, Houston, TX (US)

(72) Inventors: Daniel Moos, Palo Alto, CA (US); Silviu Livescu, Calgary (CA)

(73) Assignee: Baker Hughes, a GE company, LLC, Houston, TX (US)

( * ) Notice: Subject to any disclaimer, the term of this patent is extended or adjusted under 35 U.S.C. 154(b) by 121 days.

(21) Appl. No.: 14/828,902

(22) Filed: Aug. 18, 2015

(65) Prior Publication Data

US 2016/0053611 A1 Feb. 25, 2016

Related U.S. Application Data

(60) Provisional application No. 62/040,508, filed on Aug. 22, 2014.

(51) Int. Cl.
*E21B 41/00* (2006.01)
*E21B 43/263* (2006.01)
(Continued)

(52) U.S. Cl.
CPC ..... *E21B 43/267* (2013.01); *E21B 28/00* (2013.01); *E21B 43/263* (2013.01)

(58) Field of Classification Search
CPC ..... E21B 49/00; E21B 28/00; E21B 41/00; E21B 43/26; E21B 43/003; E21B 43/263; E21B 43/267
See application file for complete search history.

(56) References Cited

U.S. PATENT DOCUMENTS 4,858,130 A * 8/1989 Widrow ..... E21B 43/26 166/250.09
5,228,508 A * 7/1993 Facteau ..... E21B 28/00 166/177.2

(Continued)

FOREIGN PATENT DOCUMENTS

WO WO2007105167 9/2007

OTHER PUBLICATIONS

Korean Intellectual Property Office; International Searching Authority; International Search Report and Written Opinion for Application No. PCT/US2015/045883 dated Nov. 30, 2015.

(Continued)

*Primary Examiner* — David J Bagnell
*Assistant Examiner* — Dany E Akakpo
(74) *Attorney, Agent, or Firm* — Parsons Behle & Latimer

(57) ABSTRACT

A system and method of applying periodic energy pulses to a portion of a wellbore, fracture(s), and/or near wellbore to interrogate and/or stimulate at least a portion of the wellbore, fracture(s), and/or near wellbore. The system includes a downhole device that is configured to deliver periodic energy pulses to a portion of the wellbore. The downhole device may deliver various energy pulses such as pressure waves, seismic waves, and/or acoustic waves. Sensors may determine properties of a portion of the wellbore and/or fracture based on energy pulses detected within the wellbore. The sensors may be connected to the downhole tool, may be positioned within the wellbore, and/or may be positioned at the surface. The magnitude and/or frequency of the periodic energy pulses may be varied to change the stimulation and/or interrogation of the wellbore.

27 Claims, 6 Drawing Sheets

(51) Int. Cl.

| | |
|---|---|
| ***E21B 43/267*** | (2006.01) |
| ***E21B 49/00*** | (2006.01) |
| ***E21B 28/00*** | (2006.01) |

(56) References Cited

U.S. PATENT DOCUMENTS

| | | | | |
|---|---|---|---|---|
| 5,984,578 | A * | 11/1999 | Hanesian | B09C 1/00 166/177.2 |
| 2004/0226715 | A1 | 11/2004 | Willberg et al. | |
| 2008/0271923 | A1 | 11/2008 | Kusko et al. | |
| 2009/0288820 | A1* | 11/2009 | Barron | E21B 49/00 166/249 |
| 2011/0011576 | A1* | 1/2011 | Cavender | E21B 33/13 166/177.1 |
| 2012/0111560 | A1 | 5/2012 | Hill et al. | |
| 2012/0327742 | A1 | 12/2012 | Kusko et al. | |
| 2013/0161007 | A1 | 6/2013 | Wolfe et al. | |
| 2013/0220598 | A1 | 8/2013 | Palumbo et al. | |
| 2014/0076559 | A1* | 3/2014 | Ogle | C09K 8/68 166/280.2 |
| 2016/0230515 | A1* | 8/2016 | Hunter | E21B 49/00 |

OTHER PUBLICATIONS

Columbia Patent Office; Substantive Office Action; Columbian Patent Application No. NC2017/0002313; dated May 23, 2018.

New Zealand Intellectual Property Office; Office Action; IP No. 729823; dated Aug. 6, 2018.

Canadian Intellectual Property Office; Office Action; Canadian Patent Application No. 2,958,765; dated Nov. 1, 2018.

Columbian Patent Office; Office Action No. 12570; Columbian Patent Application No. NC2017-0002313; dated Oct. 19, 2018.

* cited by examiner

SYSTEM AND METHOD FOR USING PRESSURE PULSES FOR FRACTURE STIMULATION PERFORMANCE ENHANCEMENT AND EVALUATION

RELATED APPLICATION DATA

The present application claim the benefit of priority under 35 U.S.C. § 119 to U.S. Provisional Patent Application No. 62/040,508, filed Aug. 22, 2014, entitled "System and Method for Using Pressure Pulses for Fracture Stimulation Performance Enhancement and Evaluation," the disclosure of which is incorporated by reference herein in its entirety.

FIELD OF THE DISCLOSURE

The embodiments described herein relate to a system and method of applying periodic energy pulses to a portion of a wellbore, fracture(s), and/or near wellbore to interrogate and/or stimulate at least a portion of the wellbore, fracture(s), and/or near wellbore.

BACKGROUND

Description of the Related Art

Hydraulic fracturing of a wellbore has been used for more than 60 years to increase the flow capacity of hydrocarbons from a wellbore. Hydraulic fracturing pumps fluids into the wellbore at high pressures and pumping rates so that the rock formation of the wellbore fails and forms a fracture to increase the hydrocarbon production from the formation. Proppant may be used to hold open the fracture after the fracturing pressure is released. While hydraulic fracturing may be used to increase hydrocarbon production by creating fractures within a wellbore, the condition of the fracture may not be known. An analysis of the fracture may be beneficial to determine the optimal pressure required to change a property of a fracture and potentially increase hydrocarbon production from the fracture.

It may be beneficial to develop systems and methods that could be used to improve the performance of typical hydraulic fracturing techniques. It may also be beneficial to develop system and methods that may be used to analyze the wellbore and fracture properties before, during, and after hydraulic fracturing.

SUMMARY

The present disclosure is directed to a system and method for using pressure pulses that overcomes some of the problems and disadvantages discussed above.

One embodiment of a wellbore system comprises a work string and a downhole device connected to a portion of the work string, the downhole device configured to deliver periodic energy pulses to a portion of a wellbore. The system may include at least one sensor configured to measure energy pulses in the portion of the wellbore, wherein the at least one sensor is configured to determine at least one property of the wellbore based on the energy pulses detected by the at least one sensor. The at least one sensor may be connected to the downhole device. The periodic energy pulses may comprise seismic waves and the at least one sensor may comprise a geophone. The periodic energy pulses may comprise pressure waves and the at least one sensor may comprise a pressure sensor.

The portion of the wellbore may comprise at least one fracture in the formation. The system may include a first isolation element and a second isolation element such that a fracture is positioned between the isolation elements. The isolation elements may be packing elements. The system may include a first packing element, wherein the first packing element is positioned below the at least one fracture and the downhole device is positioned adjacent the at least one fracture. The system may include a second packing element, wherein the second packing element is positioned above the downhole device. The work string may be coiled tubing. The downhole device may be a vibratory tool and the periodic energy pulses may be oscillating pressure waves. The vibratory tool may be a fluid hammer tool that creates the oscillating pressure waves based on the Coandă effect. The frequency and/or amplitude of the oscillating pressure waves may be varied during operation of the fluid hammer tool.

The downhole device may be an acoustic device and the periodic energy pulses may be acoustic waves. The system may include proppant positioned within the at least one fracture and the proppant may be configured to release energy when actuated by the periodic energy pulses. The proppant may be explosive proppant or flagration proppant. The proppant may be various proppant disclosed in U.S. provisional patent application No. 62/040,441 entitled Hydraulic Fracturing Applications Employing Microenergetic Particles by D. V. Gupta and Randal F. LaFollette filed on Aug. 22, 2014, which is incorporated by referenced herein. The at least one sensor may be configured to measure energy pulses in the portion of the wellbore from the periodic energy pulses. The at least one sensor may be connected to the downhole device. The at least one sensor may be configured to determine at least one property of the at least one fracture based on energy pulses detected by the at least one sensor. The at least one property may be a width of the fracture, a length of the fracture, a shape of the fracture, and/or a propped length of the fracture.

One embodiment is a method of supplying energy pulses to a portion of a wellbore comprising positing a downhole device adjacent a portion of a wellbore and delivering periodic energy pulses from the downhole device to the portion of the wellbore. The method may include determining one or more properties of the wellbore based on energy pulses reflected from the wellbore. The portion of the wellbore may include at least one fracture. The method may include determining one or more properties of the at least one fracture. The property may be a length of the fracture, a width of the fracture, a propped length of the fracture, a propped width of the fracture, and/or a shape of the fracture.

The method may include modifying a frequency of the periodic energy pulses in real-time. The method may include modifying a magnitude of the periodic energy pulses in real-time. The method may include reevaluating in real-time the one or more properties of the wellbore on the modified reflected energy pulses. The method may include modifying in real-time a flow rate of a fluid flowing through the downhole device to modify the frequency and magnitude of the periodic energy pulses. The method may include modifying in real-time a signal to the downhole device to modify the frequency and magnitude of the periodic energy pulses in real-time. The method may include changing a property of the fracture with the periodic energy pulses. The periodic energy pulses may enlarge a width and/or a length of the fracture. The periodic energy pulses may inhibit growth of the fracture. The periodic energy pulses may increase the conductivity of the fracture. The method may include cleaning up the at least one fracture with the periodic energy pulses. Cleaning up the at least one fracture may include enhancing transport of proppant into the at least one fracture or breaking down a layer of a formation adjacent to the at least one fracture having a low-permeability.

One embodiment is a wellbore system comprising a work string, at least one downhole device connected to a portion of the work string, the downhole device configured to deliver periodic energy pulses to a portion of the wellbore, and at least one sensor configured to determine at least one property of the wellbore based on detected energy pulses. The downhole device is configured to selectively modify a magnitude and a frequency of the periodic energy pulses. The periodic energy pulses may be pressure waves, acoustic waves, and/or seismic waves.

Figure 1:
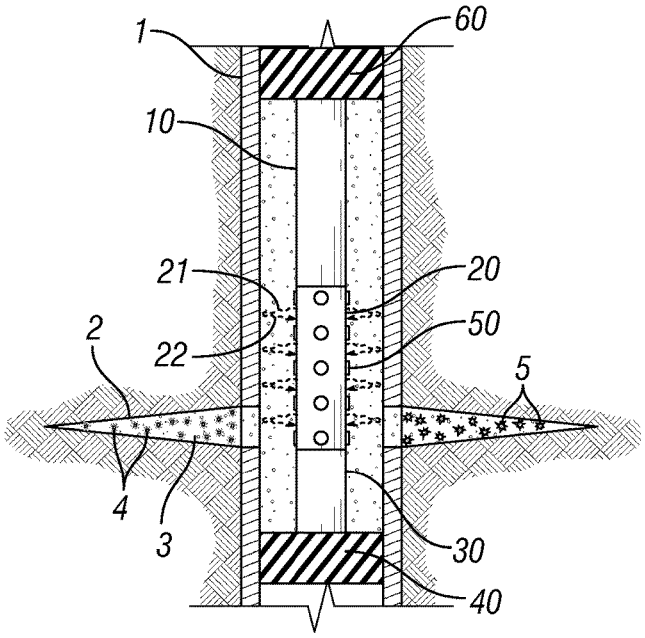
FIG. 1 shows an embodiment of a downhole device configured to provide energy pulses to a portion of a wellbore.

While the disclosure is susceptible to various modifications and alternative forms, specific embodiments have been shown by way of example in the drawings and will be described in detail herein. However, it should be understood that the disclosure is not intended to be limited to the particular forms disclosed. Rather, the intention is to cover all modifications, equivalents and alternatives falling within the scope of the invention as defined by the appended claims.

DETAILED DESCRIPTION

Figure 2:
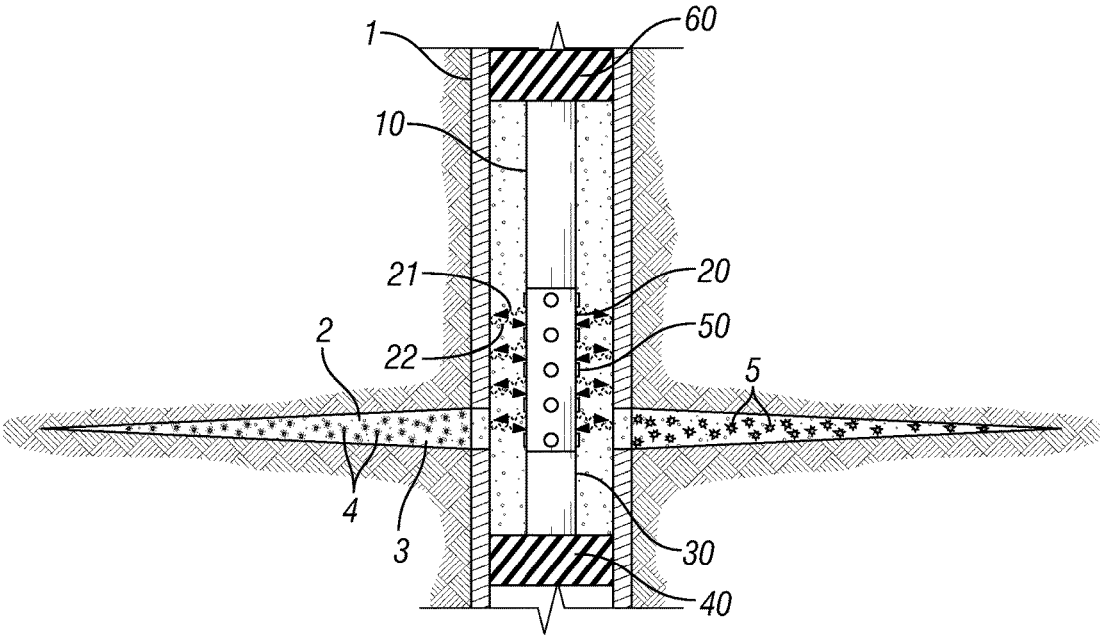
FIG. 2 shows the embodiment of a downhole device of FIG. 1 with the magnitude and frequent of the energy pulses modified as well as a change to a fracture in the wellbore.
Figure 3:
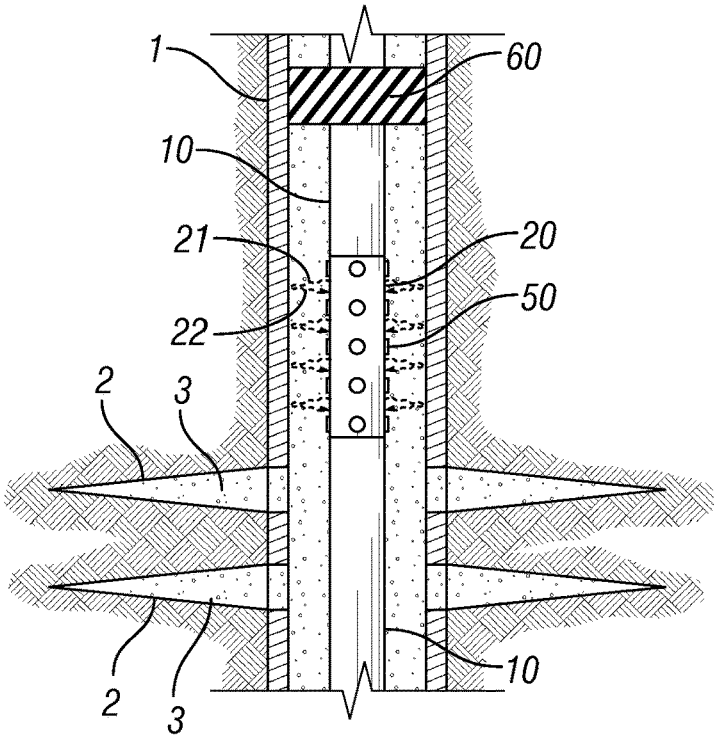
FIG. 3 shows an embodiment of a downhole device configured to provide energy pulses to a portion of a wellbore positioned above a fracture.
Figure 4:
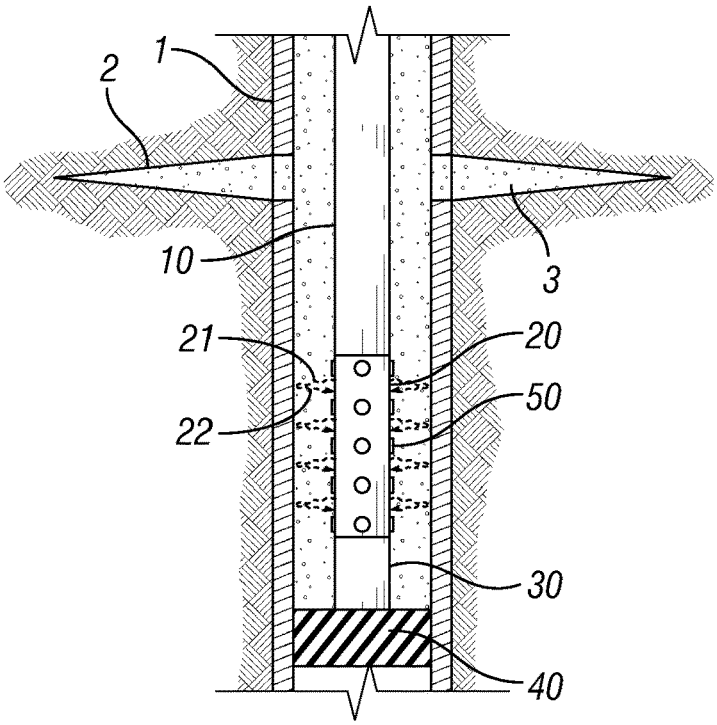
FIG. 4 shows an embodiment of a downhole device configured to provide energy pulses to a portion of a wellbore positioned below a fracture.
Figure 5:
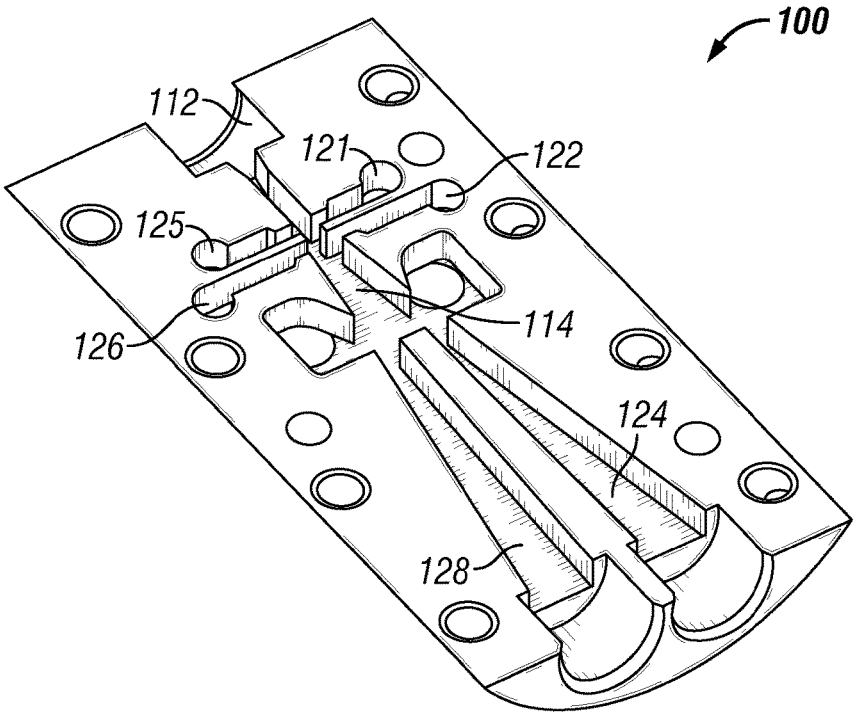
FIG. 5 shows a portion of an embodiment of a vibratory downhole device configured to provide energy pulses to a portion of a wellbore.

FIG. 1 shows downhole device 20 connected to a work string 10 positioned within a casing, or tubing, 1 of a wellbore. The downhole device 20 is configured to deliver periodic energy pulses, shown as waves 21, to a portion of a wellbore. The downhole device may be various devices that are configured to deliver of periodic energy pulses. For example, the downhole device 20 may be an acoustic device that delivers acoustic waves as shown in FIG. 1 and FIG. 2. In another embodiment, the downhole device 20 may generate seismic waves as shown in FIG. 3. In another embodiment, the downhole device 20 may be a vibratory device that generates pressure waves such as shown in FIG. 4 and, as shown in FIG. 5.

The downhole device 20 is connected to a work string 10 that is used to position the downhole device 20 at a desired location within the wellbore. The work string 10 may be various types work strings or combinations of various types of works strings such as wireline, coiled tubing, or jointed tubing as would be appreciated by one of ordinary skill in the art having the benefit of this disclosure. The downhole device 20 may be positioned adjacent to a portion of a wellbore that is desired to be stimulated by the periodic energy pulses and/or interrogated by the periodic energy pulses. The downhole device 20 may be positioned within a wellbore adjacent to a fracture 2 such that the periodic energy pulses 21 may be delivered to the fracture 2 and the formation surrounding the fracture 2. Reflective energy pulses 22 will be reflected by the wellbore and be returned to the downhole device 20. Sensors 50 may record and/or analyze the reflective energy pulses 22 to determine in real-time various characteristics of the fracture and/or wellbore as will be discussed herein. The sensors 50 could be used to determine properties of wellbore components based on the energy pulses within the wellbore. The sensors 50 may be connected to the downhole device 20 and/or may be positioned at the surface or at various locations within the wellbore. The sensors 50 may be battery powered sensors positioned within the wellbore. The sensors 50 positioned within the wellbore may record the measurements from the energy pulses in memory and/or may transmit the measurements to the surface via various mechanisms such as an e-line within or along the work string 10. The sensors 50 positioned within the wellbore could transmit measurements to the surface via other mechanisms such as via TELECOIL™ offered commercially by Baker Hughes of Houston, Tex.

The downhole device 50 may be positioned between two isolation elements to focus the periodic energy pulses 21 and reflective energy pulses 22. For example, the downhole device 50 may be positioned between the packing element 40 and 60 that may be actuated within the casing 1 of the wellbore to focus the periodic energy pulses 21 and reflective energy pulses 22 within a desired portion of the wellbore. The packing elements 40 and 60 may be connected to the downhole device 20 and/or the work string 10 via a packer tool 30 used to actuate the packing element 40 between an actuated and non-actuated state. A single packing element 40 may be used below the downhole device 20. Likewise, the downhole device 20 may be used to generate periodic energy pulses 21 within the wellbore without an upper packing element 60 or a lower packing element 40.

The periodic energy pulses 21 may be used to interrogate a fracture 2 to determine various properties of the fracture 2, such as width of the fracture, length of the fracture, propped length of the fracture, propped width of the fracture, conductivity of the fracture, compliance of the fracture, and/or shape of the fracture. The periodic energy pulses 21 may be used to stimulate or inhibit growth in a fracture 2 in a wellbore. FIG. 2 shows a change in the length of the fracture 2, shown in FIG. 1, due to the action of the periodic energy pulses 21. The periodic energy pulses 21 may be used to deliver energy to a fracture 2. The energy delivered to a fracture 2 may trigger proppant 3 located within the fracture 2. For example, the proppant 3 may be explosive proppant 5 and the periodic energy pulses 21 may cause the explosive proppant 5 to release energy or explode. In another example, the periodic energy pulses 21 may trigger the proppant 3 to cross-link. The proppant may be flagration proppant 4, which undergoes a controlled burn when actuated by the periodic energy pulses 21.

The magnitude and/or frequency of the periodic energy pulses 21 from the downhole device 20 may be varied during the interrogation and/or stimulation. FIG. 2 shows the periodic energy pulses 21 having a change in both magnitude and frequency with regards to the periodic energy pulses 21 depicted in FIG. 1. The change in magnitude and frequency is shown schematically by a different size and number of arrows shown in connection with energy pulses 21 and 22, in comparison to FIG. 1. In the instance that the downhole device 20 is an acoustic device may be an acoustic device such as the XMAC F1™ tool offered commercially by Baker Hughes of Houston, Tex., as shown in FIG. 1 and FIG. 2, or a seismic device such as SeisXplorer™ offered commercial by Baker Hughes of Houston, Tex., as shown in FIG. 3, the signal being supplied to the downhole device 20 may be varied to cause the generated periodic energy pulse 21 to change in magnitude and/or frequency. The frequency and/or magnitude may also be varied by variation in the flow of fluid through the downhole device 20. For example, if the downhole device 20 is a vibratory device, such as a fluid hammer tool shown in FIG. 4 and FIG. 5, the change of flow in fluid through the device 20 may change the magnitude and/or frequency of the periodic energy pulses 21.

FIG. 3 shows a downhole device 20, which generates seismic energy pulses 21, that is positioned above multiple fractures 2. The seismic energy pulses 21 generated from the downhole device 20 may be used to interrogate a portion of the wellbore. A single packer 60 may be used to focus the pulses 21 to a desired portion of the wellbore. As shown in FIG. 3, the downhole device 10 may be positioned along a work string 10 with the work string 10 extending above and below the downhole device 20. Although not shown in FIG. 3, the downhole device 20 may be positioned adjacent a fracture(s) 2 so that the seismic pulses 21 stimulate and/or interrogate the fracture(s) 2.

FIG. 4 shows a downhole device 20, which generates pressure pulses 21, that is positioned below a fracture 2 within the wellbore. A packer 40 may be positioned below the downhole device 20 to focus the pressure pulses 21 on a desired portion of the wellbore. Pressure sensors 50 may be used to monitor the energy pulses in the wellbore to analyze properties of the wellbore. Although not shown in FIG. 4, the downhole device 20 may be positioned adjacent a fracture 2 so that the pressure pulses 21 stimulate and/or interrogate the fracture 2.

The downhole device 20 may be vibratory device that generates periodic energy pulses 20 with the wellbore. For example, the vibratory device may be a fluid hammer tool such as the EasyReach Extended-Reach Tool™ offered commercially by Baker Hughes of Houston, Tex. The vibratory device may be a fluid hammer tool that oscillates creating periodic pulses based on the Coandă effect. U.S. Pat. No. 8,727,404 entitled Fluidic Impulse Generator, which is incorporated by reference in its entirety herein, discloses a vibratory downhole device that may be applicable to produce the desired periodic energy pulses.

FIG. 5 shows a portion of a vibratory downhole device 100 that may be used to generate periodic energy pulses 21 within a wellbore. The vibratory downhole device 100 includes an input power port 112 through with fluid is input into the device 100. Fluid pumped down the work string 10 enters the vibratory downhole device 100 through the input power port 112. The device 100 includes a first power path 124 and a second power path 128 that are both connected to the input power port 112 via a connecting power path 114. The fluid flowing through the device 100 will alternate between flowing down the first power path 124 and the second power path 128 due to the Coandă effect based on fluid inputs from triggering paths 122 and 126 and feedback paths 121 and 125 as detailed in U.S. Pat. No. 8,727,404 with the alternate flow being used to create periodic pressure pulses 21.

Figure 6:
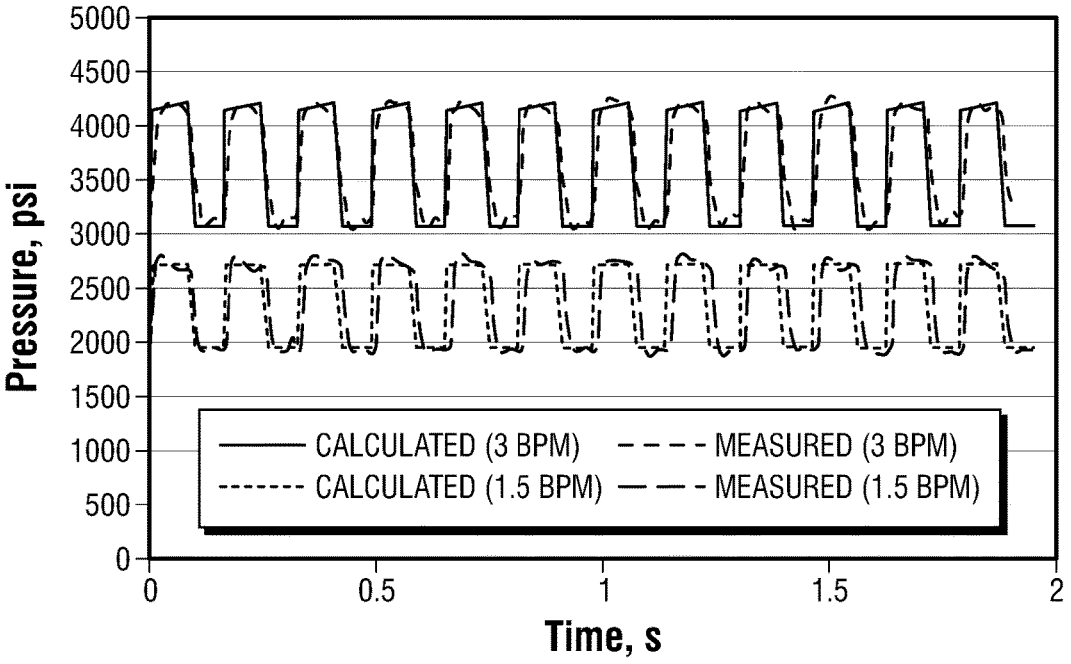
FIG. 6 shows a graph showing periodic energy pulses, both calculated and measured, at a surface pumping rate of 1.5 barrels per minute (bpm) and 3.0 bpm.

It may be beneficial to use a downhole device 20 to provide a periodic energy pulse 21 to a fracture 2 of a wellbore during the hydraulic fracturing of the fracture 2. The same downhole device 20 may be used to interrogate the wellbore and/or stimulate the wellbore. It may be important that such a downhole device 20 be able to produce consistent energy pulses over a long period of time. FIG. 6 shows a chart indicating calculated pressure pulses using an EasyReach™ fluid hammer tool at surface pumping rates of 1.5 bpm and 3 bpm. FIG. 6 shows that the EasyReach™ tool is able to generate consistent energy pulses as indicated by the measured pressure pulses at 1.5 bpm and 3 bpm surface pumping rates.

A computer model, based on the Method of Characteristics, was developed for the EasyReach™ tool by the inventors to assess the fracture capability as a pressure pulse resonator. The mathematical model assumes that the wellbore and the fracture are tubes for which the wave speed is known. The wave propagation speed in coiled tubing is provided for by the following equation with ρ for the fluid density, w for the wall thickness of the coiled tubing, d is the outside diameter of the coiled tubing, E for Young's modulus of the coiled tubing material, and K for the fluid bulk modulus.

$$c = \left[\rho\left(\frac{1}{K} + \frac{d}{wE}\right)\right]^{-0.5}$$

The wave speed downstream of the downhole device 20 can be interpolated from a given frequency and complex velocity table, depending on the wellbore and/or fracture properties. At any given time, the tool frequency may be used to calculate the wave speed in the wellbore and fracture. During simulation the frequency of periodic energy pulses from the EasyReach™ tool starts at 7 Hz and vary between 5 Hz and 9 Hz. The frequency for other downhole devices 20 may vary with respect to the frequencies of the EasyReach™ tool. FIGS. 7-11 show graphs based on the computer module and simulation results using the EasyReach™ tool that represent the fracture pressure evolution over time and illustrate that a fracture is an effective resonant system. Thus, periodic energy pulses, and in particular pressure pulses, may enhance the fracture stimulation performance. The ability to vary the magnitude and frequency of the periodic energy pulses from a downhole device 20 may permit the interrogation and/or stimulation of a resonant system such as a fracture.

Figure 7:
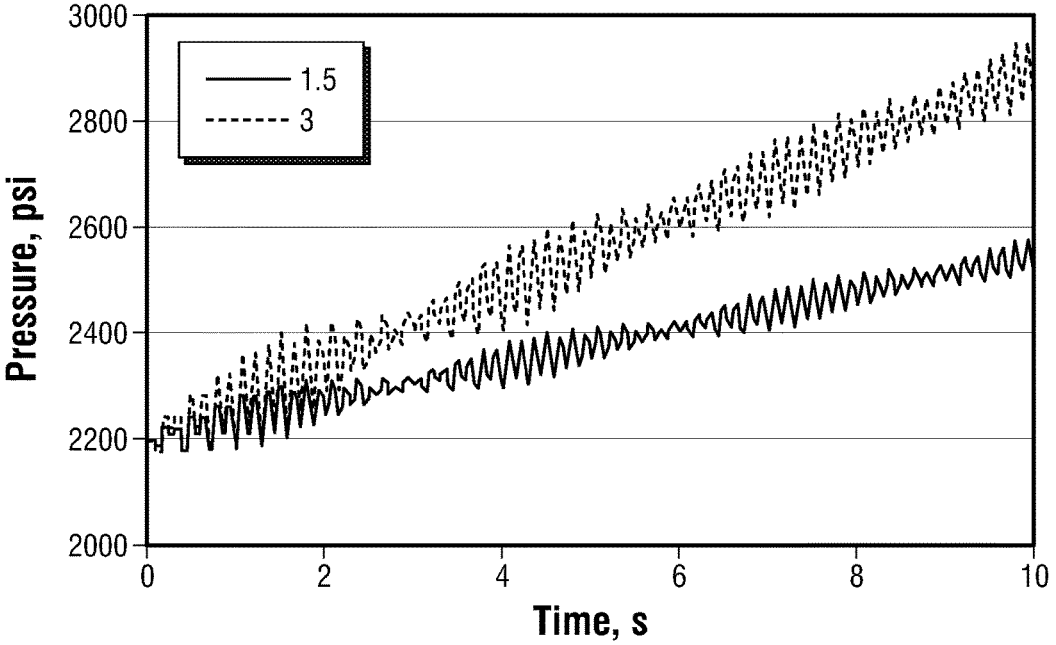
FIG. 7 shows a graph illustrating the effect of pumping rate on fracture pressure near the wellbore for both a surface pumping rate of 1.5 bpm and 3 bpm.

FIG. 7 shows a simulation indicating the effect of the surface pumping rate on the fracture pressure near the wellbore. The EasyReach™ fluid hammer tool is used to generate periodic pressure waves. Both the fracture and well downstream of the tool are 164 feet (50 m) long and both are closed. The well internal diameter is modeled having a diameter of 5.5 inches with the fracture having an internal diameter of 1 inch. FIG. 7 shows data for a surface pumping rate of 1.5 bpm and a surface pumping rate of 3 bpm. As expected, a surface pumping rate of 3 bpm produces a higher fracture pressure than a surface pumping rate of 1.5 bpm. The increase in wave amplitude over time is due to the waves traveling back and forth in both the well and the fracture.

Figure 8:
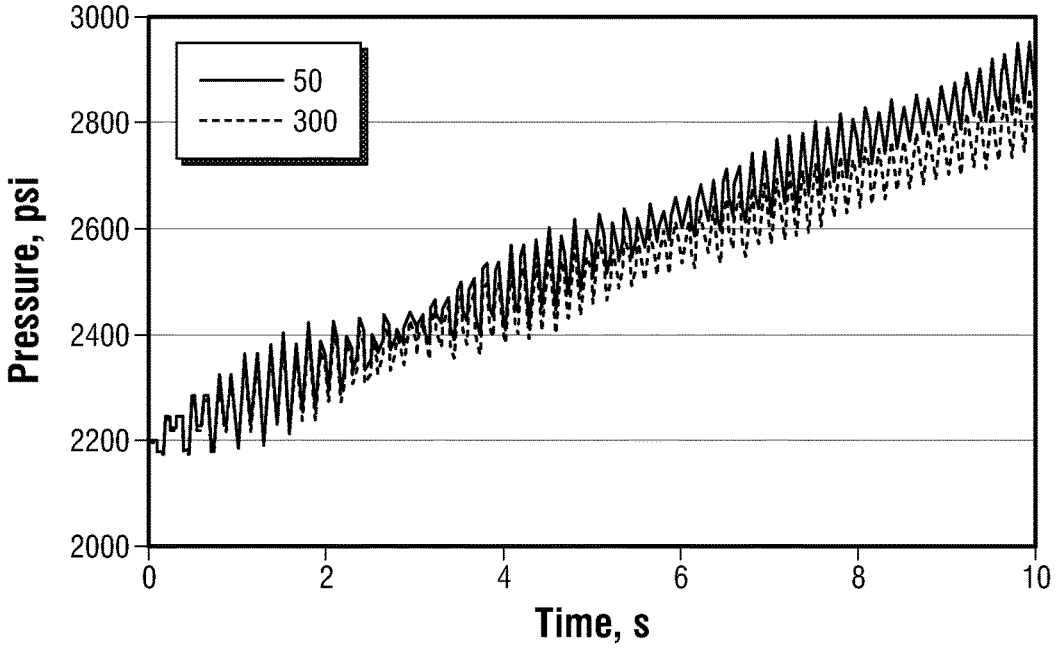
FIG. 8 shows a graph illustrating the effect of fracture length on the fracture pressure for a fracture length of fifty (50) meters and a fracture length of three hundred (300) meters.

FIG. 8 shows the effect on the fracture length on the fracture pressure near the wellbore. FIG. 8 shows the effect on two different fracture lengths, a fracture length of 164 feet (50 m) and a fracture length of 984 feet (300 m). The surface pumping rate for this simulation is 3 bpm. Both fractures are considered closed tubes having a 1 inch internal diameter. The fracture pressure is larger for a fracture having a shorter length as the same amount of pumping fluid has a larger contribution in a small volume of fracture.

Figure 9:
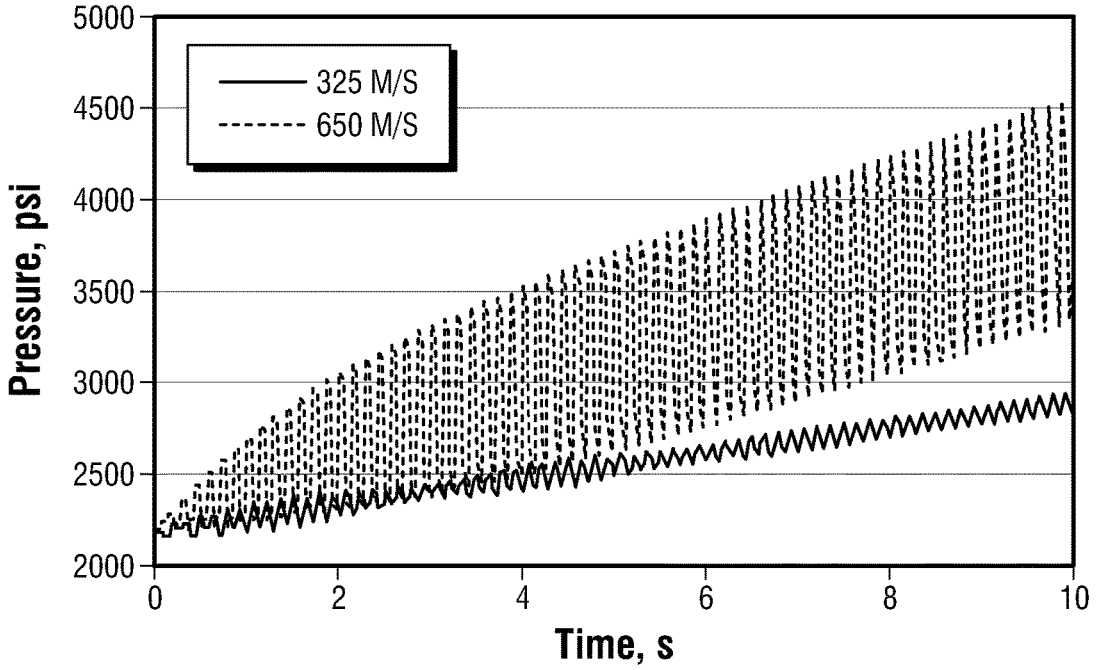
FIG. 9 shows a graph illustrating the effect of the well and fracture wave speed on the fracture pressure near the wellbore.

FIG. 9 shows the effect of the well and fracture wave speed on the fracture pressure near the wellbore. The two wave speeds simulated were 325 m/s and 650 m/s. As shown in FIG. 9, an increase in wave speed in a closed well and/or fracture system increases the fracture pressure significantly as the waves travel back and forth faster.

Figure 10:
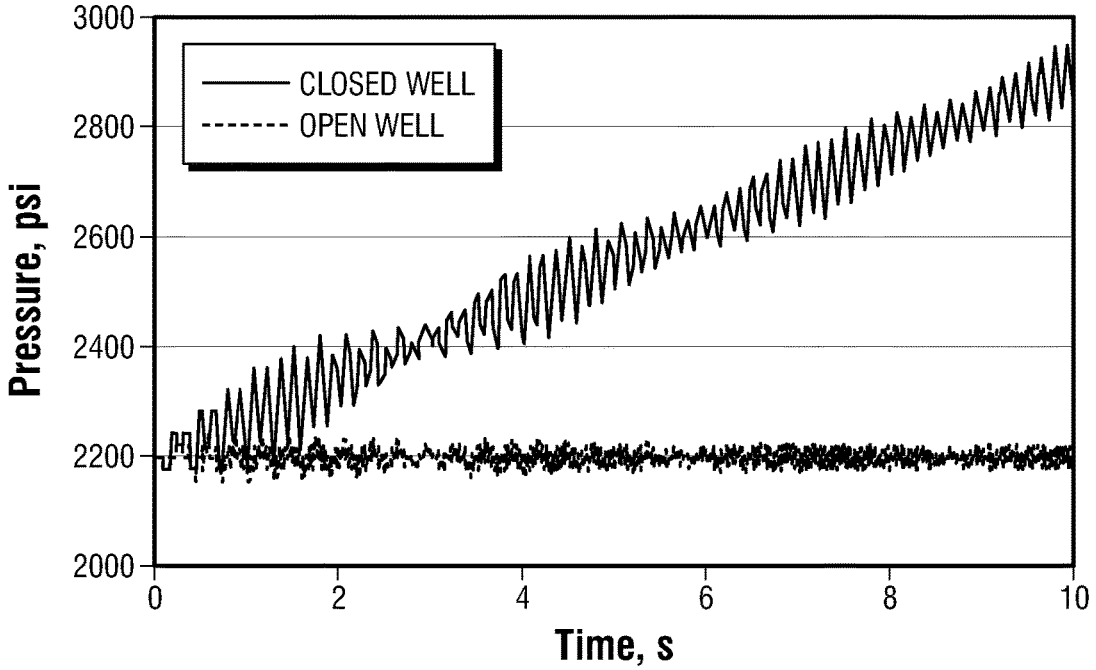
FIG. 10 shows a graph illustrating the effect of well boundary condition on fracture pressure near the wellbore.

FIG. 10 shows the effect of the well boundary condition (i.e., whether the well is open or closed) on the fracture pressure near the well. In the closed well simulation, a packer is used to close the well and focus the waves within a location within the wellbore. No packer is used in the open well simulation. As would be expected, the fracture pressure near the wellbore is significantly higher when a packer is used to close the wellbore than the open well system.

Figure 11:
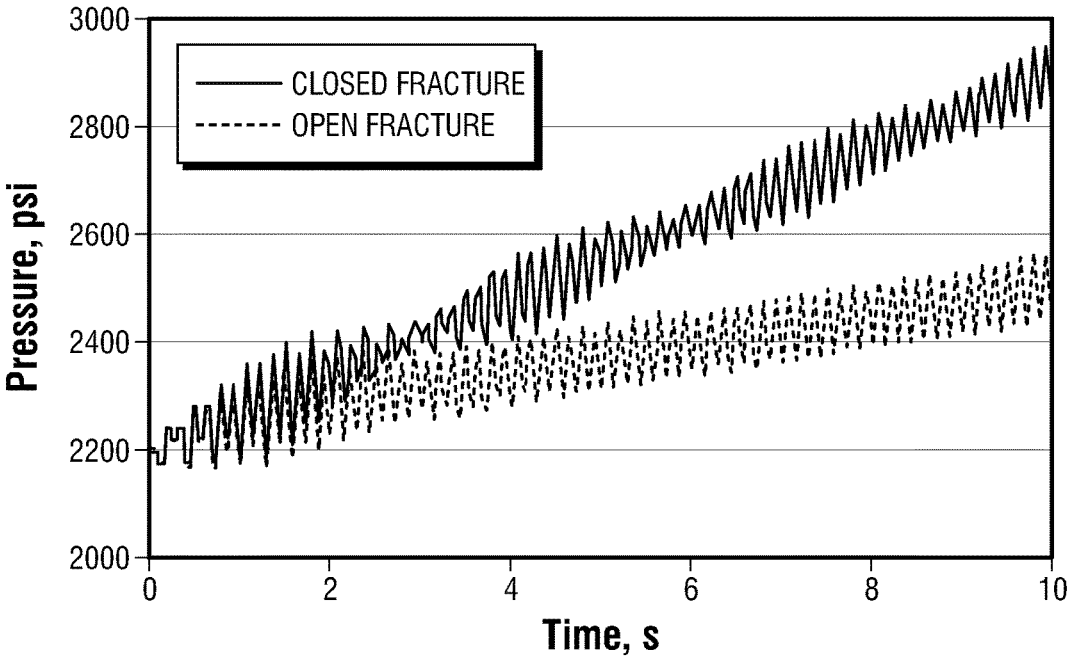
FIG. 11 shows a graph illustrating the effect on whether the fracture is open or closed on fracture pressure near the wellbore.

FIG. 11 shows the effect on fracture pressure on whether the fracture is open (open fracture) or closed (closed fracture). The fracture pressure near the wellbore is larger in a closed fracture than in an open fracture. The simulations indicate that applying periodic energy pulses and using a packer would increase fracture pressure significantly. Further, the fracture response varies for different facture properties.

By delivering periodic energy pulses 21 to a portion of a wellbore and fracture 2, the properties of the wellbore and/or fracture 2 may be determined by mathematically modeling the system as a resonant system based on wave data within the wellbore. The wave data within the wellbore may be provided by sensors 50 connected to the downhole device, sensors 50 positioned within the wellbore, and/or sensors 50 at the surface. In addition to interrogating the wellbore and fracture 2, the periodic energy pulses 21 may be used to effect changes in a fracture as discussed herein.

Although this invention has been described in terms of certain preferred embodiments, other embodiments that are apparent to those of ordinary skill in the art, including embodiments that do not provide all of the features and advantages set forth herein, are also within the scope of this invention. Accordingly, the scope of the present invention is defined only by reference to the appended claims and equivalents thereof.

What is claimed is:

1. A method of supplying energy pulses to a portion of a wellbore comprising:

positioning a fluid hammer vibratory tool adjacent a portion of a wellbore, the fluid hammer vibratory tool having a first power path and a second power path both connected to an input power port via a connecting power path;

pumping fluid from a surface to the fluid hammer vibratory tool to create periodic energy pulses, wherein the periodic energy pulses are created by alternating the fluid flow through a portion of the fluid hammer vibratory tool between the first power path and the second power path;

delivering the periodic energy pulses from the fluid hammer vibratory tool to the portion of the wellbore, wherein the periodic energy pulses comprise oscillating pressure waves;

modifying a frequency of the periodic energy pulses in real-time;

modifying a magnitude of the periodic energy pulses in real-time; and determining one or more properties of the wellbore based on energy pulses reflected from the wellbore.

2. The method of claim 1, wherein the portion of the wellbore includes at least one fracture.

3. The method of claim 2, further comprising determining one or more properties of the at least one fracture.

4. The method of claim 3, wherein the one or more properties of the at least one fracture includes a length of the at least one fracture.

5. The method of claim 3, wherein the one or more properties of the at least one fracture includes a width of the at least one fracture.

6. The method of claim 3, wherein the one or more properties of the at least one fracture includes a propped length of the at least one fracture.

7. The method of claim 3, wherein the one or more properties of the at least one fracture includes a shape of the at least one fracture.

8. The method of claim 3, wherein the one or more properties of the at least one fracture includes a conductivity of the at least one fracture.

9. The method of claim 3, wherein the one or more properties of the at least one fracture includes a compliance of the at least one fracture.

10. The method of claim 3, wherein the one or more properties of the at least one fracture includes a propped width of the at least one fracture.

11. The method of claim 2, further comprising changing a property of the fracture with the periodic energy pulses.

12. The method of claim 11, wherein the periodic energy pulses enlarges a width or a length of the fracture.

13. The method of claim 11, wherein the periodic energy pulses inhibit growth of the fracture.

14. The method of claim 11, wherein the periodic energy pulses increase the conductivity of the fracture.

15. The method of claim 2, further comprising cleaning up the at least one fracture with the periodic energy pulses.

16. The method of claim 15, wherein cleaning up the at least one fracture further comprises enhancing transport of proppant into the at least one fracture or breaking down a layer of a formation adjacent to the at least one fracture having a low-permeability.

17. The method of claim 2, wherein delivering the periodic energy pulses from the fluid hammer vibratory tool to the portion of the wellbore occurs during hydraulic fracturing of the at least one fracture.

18. The method of claim 1, further comprising reevaluating the one or more properties of the wellbore based on modified reflected energy pulses.

19. The method of claim 1, wherein modifying a flow rate of fluid flowing through the fluid hammer vibratory tool modifies the frequency and magnitude of the periodic energy pulses.

20. The method of claim 1, comprising triggering proppant within the wellbore with the periodic energy pulses.

21. The method of claim 20, wherein trigging the proppant comprises the proppant releasing energy or exploding.

22. The method of claim 20, wherein trigging the proppant comprises the proppant undergoing a controlled burn.

23. The method of claim 20, wherein trigging the proppant cross-links the proppant.

24. The method of claim 1, comprising determining the one or more properties of the wellbore based on energy pulses reflected from the wellbore with a sensor positioned within the wellbore.

25. The method of claim 24, wherein the sensor is connected to the fluid hammer vibratory tool.

26. The method of claim 25, comprising transmitting measurements from the sensor to the surface via an e-line within a work string connected to the fluid hammer vibratory tool.

27. The method of claim 25, comprising transmitting measurements from the sensor to the surface via an e-line position along a work string connected to the fluid hammer vibratory tool.

* * * * *